United States Patent [19]

Vinches et al.

[11] 4,062,267

[45] Dec. 13, 1977

[54] APPARATUS FOR CONDUCTING FIRING

[75] Inventors: René Vinches, L'Isle Adam; Jacques Moirez, Paris, both of France

[73] Assignee: Societe d'Optique, Precision, Electronique et Mecanique Sopelem, Paris, France

[21] Appl. No.: 742,135

[22] Filed: Nov. 10, 1976

[30] Foreign Application Priority Data

Nov. 14, 1975 France ..... 75.34881
Nov. 4, 1976 France ..... 76.33317

[51] Int. Cl.[2] ..... F41G 3/06

[52] U.S. Cl. ..... 89/41 E; 33/240; 89/41 L; 89/41 T

[58] Field of Search ..... 33/240; 89/41 E, 41 T, 89/41 L; 235/61.5 R, 61.5 DF

[56] References Cited

U.S. PATENT DOCUMENTS 2,354,153 7/1944 Stebbins ..... 89/41 E

*Primary Examiner*—Stephen C. Bentley
*Attorney, Agent, or Firm*—Haseltine, Lake & Waters

[57] ABSTRACT

Apparatus for conducting firing adapted to the aiming of a cannon movable in bearing and in elevation around a turning axis as a function of aim values given by a firing table corresponding to the cannon and other parameters of firing. The apparatus comprises a telescopic sight with an optical deviator element for displacement of the line of sight, the optical deviator element being mounted on a support coupled in bearing and in elevation with the cannon and being subjected to the action of a cam whose profile is determined by the aim values from the firing table and which is coupled to a motor controlled by a rangefinder device whose transmission and reception beams are connected in bearing and in elevation to the axis of the observation scope of the telescope. The opticial deviator element is articulated through the intermediary of a spherical articulation on the support connected to the cannon and the opticial deviator element is subjected to the signal of a detector of the vertical operating so that the observation axis must be maintained in a substantially vertical plane passing through the direction of the target.

16 Claims, 10 Drawing Figures

2
5
1
3
4
B 2
5
1
3
4
L
B 2
5
1
4
3
C
B

APPARATUS FOR CONDUCTING FIRING

FIELD OF THE INVENTION

The present invention relates to apparatus which permits the aiming of an artillery cannon movable in elevation for range and in bearing on a support of undetermined position after determination of the aiming error between the cannon and the direct observation, this error taking into account the distance of the objective and other parameters of firing.

The apparatus according to the invention can be used on a tank or an artillery vehicle.

BACKGROUND

The direction of aiming of the cannon with respect to the direction of the target takes into account a certain number of parameters. The distance between the cannon and the target requires an angle called the aim angle between the direction of the cannon and the direction of the traget. The relation between the aim angle and the distance is not linear. The platform supporting the turret of the cannon can take an undetermined position and it is necessary to take into account the inclination of the turning axis of the cannon. Different ammunition has a very variable behavior from the point of view of initial speed and ballistics and the characteristics of the cannon change in time. The variation of initial speed and the ballistic coefficient necessitate a correction in elevation. These parameters act angularly in a manner substantially proportional to the aim angle. It is also necessary to take into account lateral wind forces and the lateral shifting of the ammunition. These parameters necessitate corrections in bearing and the corrections are approximately proportional to the aim angle.

Different systems for firing are known. One system of firing comprises an observation telescope which can be a shielded telescope or a periscope. The generally accepted principle resides in the calculation of an aiming error between the cannon and the direct sight as a function of all the parameters of firing, after which a shift is made between the line of sight and the axis of the cannon so that the projectile strikes the target. The determination of the aiming error is effected from information from a rangefinder or determining the distance of the target. In U.S. Pat. No. 2,887,774, the deviation of the line of sight is effected by displacement of the cross-hairs of the sight. The cross-hairs are displaced by a cam.

The profile of the cam is determined by the successive values of the aim angle. The position of the cam around its axis is determined by the distance of the target given by a rangefinder. The displacement of the cross-hairs corresponds from this fact to the necessary angle of aim. The cam acts on the cross-hairs through the intermediary of a lever whose displacement of the articulation point by a mechanical system permits the introduction of secondary corrections such as the variation of initial speed and the ballistic coefficient. However, this system of firing does not permit taking into account the inclination and the secondary corrections cannot easily be taken into account.

In modern systems of conducting firing such as those described in French Pat. No. 2,016,096, the determination of the aiming error is effected with the aid of an electronic computer receiving information from a rangefinder of laser type. Generally, the firing information determined by the computer acts on an optically controlled deviator, situated in front of the telescope, which shifts both the observation and the transmission and reception beams of the laser rangefinder with respect to the cannon. The optical deviation is effected either by diasporameters or by a movable mirror. The computer apparatus not only determines the errors but also calculates their transformations into control parameters for the deviator systems. The known systems are, therefore, very complex.

SUMMARY OF THE INVENTION

The present invention is directed to an apparatus for conducting firing controlling the shift between the line of sight and the axis of the cannon taking into account the inclination and the distance to the target and the other firing parameters. The transformation of coordinates due to the inclination and the non-linear error corresponding to the aim values are produced not by means of a computer, but by means of electromechanical means and control mechanisms. The decomposition of errors is introduced in a particular system of coordinates. The apparatus is particularly simple in the sense that all the complex calculations are resolved mechanically. The apparatus according to the invention comprises a reduced number of control mechanisms, the mechanical portion having a suitable complexity. There is no need for a computer since the non-linear calculations are resolved mechanically and the linear calculations by the control mechanisms. The apparatus is advantageous, on the one hand, by its reliability due to the fact that the number of constituent member is reduced, and, on the other hand, by its cost. It permits deviation both of the sight and the telemetry beams and permits the measurement of distance at any instant. The apparatus is provided with good thermal stability and it has invariable optical properties. The apparatus according to the invention, when it contains a laser rangefinder, permits aiming a cannon with a total accuracy which can reach five ten thousandths, taking into account the main parameters acting on the accuracy of the sight.

The apparatus for conducting firing according to the invention is adapted to the aiming of a cannon movable in bearing and in elevation around a turning axis as a function of aim values given by a firing table corresponding to the cannon and other parameters of firing and it comprises a telescopic sight with an optical deviator element for displacement of the line of sight, this optical deviator element being mounted on a support coupled in bearing and in elevation with the cannon and being subjected to the action of a movable cam whose profile is determined by the aim values from the firing table and which is coupled to a motor controlled by a rangefinder whose transmission and reception beams are connected in bearing and in elevation to the axis of the observation scope of the telscope and it is characterized by the fact that the said optical deviator element is articulated through the intermediary of a spherical articulation on the support connected to the cannon and that it is subjected to the signal of a detector of the vertical operating so that the observation axis must be maintained in a substantially vertical plane passing through the direction of the target.

According to a feature of the invention, the spherical articulation is an articulation having a cardan joint and the apparatus comprises a rectilinear guide member fixed to a rotatable shaft coupled to the vertical detector and further a slide secured to the optical deviator element and guided on the said guide member.

The apparatus for conducting firing according to the invention is adapted for the aiming of a cannon movable in bearing and in elevation around a turning axis as a function of the values given by the firing table corresponding to the cannon and of the other parameters of firing and it comprises an observation telescope with an optical deviator element serving for displacement of the line of sight, this optical deviator element being mounted on a support coupled in bearing and in elevation to the cannon and being controlled by a movable cam whose profile is determined by the values of the aim from the firing table and which is coupled to a motor controlled by a rangefinder whose transmission and reception beams are coupled in bearing and in elevation to the observation axis of the telscope and it is characterized by that fact that the said optical deviator element is guided in a manner to displace the line of observation in a plane perpendicular to the turning axis and by the fact that it comprises another optical deviator element which is movable under the action of a motor controlled by a signal from a detector of the vertical so as to rotate the image of the scene in such a manner that a vertical in the scene is seen substantially perpendicular to the axis of turning.

The invention will now be described in greater detail referring to some embodiments given by way of example and shown in the drawings.

DETAILED DESCRIPTION

Figures 1, 2, 3:
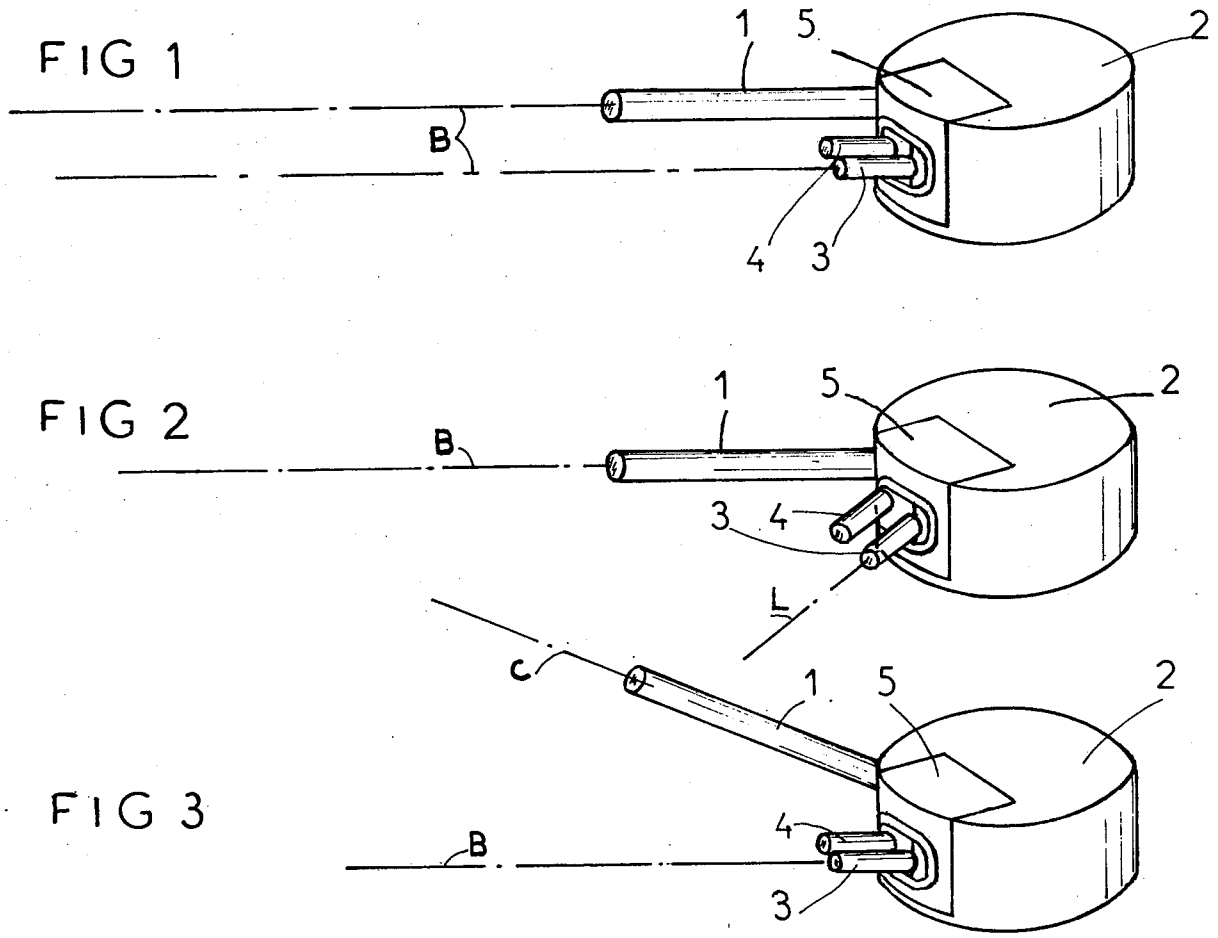
FIGS. 1, 2 and 3 are diagrammatic illustrations representing different positions of the cannon and the observation scope and of the rangefinder apparatus in the course of different phases of the firing.

Referring to FIGS. 1 to 3, the apparatus conforming to the invention is designed to effect the aiming of a cannon 1 mounted on a turret 2 whose orientation can be variable.

The cannon 1 is movable in bearing by rotation of the turret and in elevation. The apparatus comprises an observation telescope 3 and a telescope 4 of a laser rangefinder whose optical axis is parallel to the optical axis of the observation scope. This scope 4 is used by the transmission beam of the laser rangefinder, the reception beam using the objective of the scope. The transmission and reception beams of the laser rangefinder can also pass through the optical system of the observation scope, the laser telemeter being integrated in the observation scope. The scopes are supported through the intermediary of an articulation, in a support 5, coupled in bearing and in elevation to the cannon. This support can be the shield of the cannon. This can also be a support independent from the cannon.

FIGS. 1 to 3 illustrate the different stages for conducting firing. Initially (FIG. 1) the observation scope 3 is pointed, by the sighter or the tank commander in the direction B, that is to say, towards the target. The cannon 1 and the scope 4 and also directed towards the target. The laser rangefinder is put in operation and the distance to the target is determined.

The apparatus for conducting firing according to the invention then shifts the line of sight and the line of range by orienting the scopes 3 and 4 with respect to the support 5. The difference between the line of sight L and the direction B of the target takes into account the angle of aim and the inclination of the turret as well as other parameters of firing. The cannon remains aimed in the direction B of the target as this is shown in FIG. 2.

The scopes after determination of corrections, remain immobilized on the support 5. The line of sight L is reset on the target along the direction B by displacement of the cannon 1 around its pivots and by rotation of the turret 2. While the scopes are mounted directly on the shield of the cannon, the orientation of the shield and the rotation of the turret permits resetting the line of sight L in the direction B, the final direction of the cannon being designated C in FIG. 3.

Figure 4:
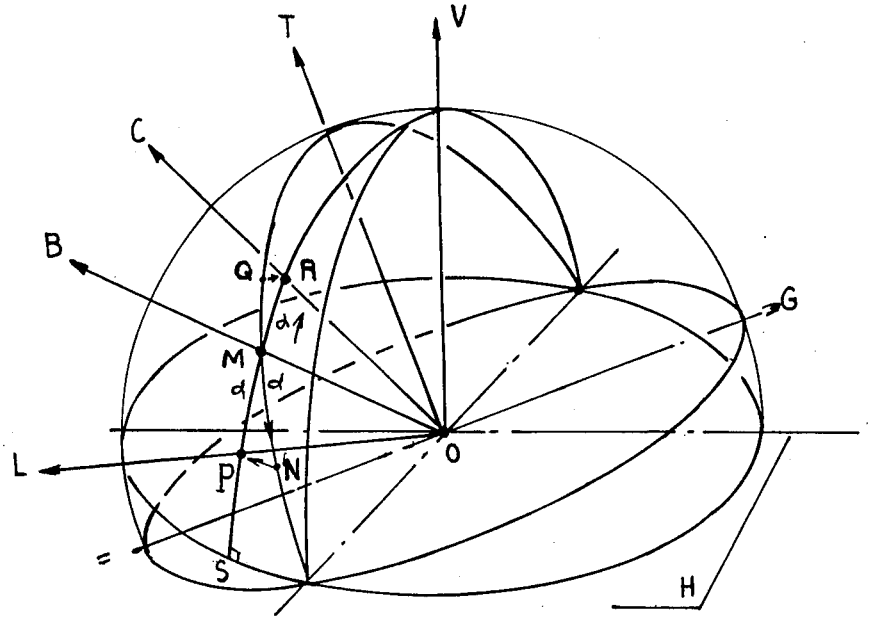
FIG. 4 is a diagrammatic illustration adapted to show the transformation of coordinates effected by the apparatus according to the invention and the relative displacements in space of the axes of sight and of range and of the axis of the cannon.

FIG. 4 geometrically illustrates the displacements of the line of sight and of the axis of the cannon. In this figure, the position of the tank is designated O, the direction of the vertical is designed V, T designating the axis of rotation of the turret and G the turning axis of the cannon. The direction B represents the direction of the target indicated elsewhere in FIGS. 1 to 3. As this was previously explained, the scope is pointed initially at the target in the direction B. The scopes 3 and 4 are shifted from the direction B as a function of the parameters of firing.

Figure 5:
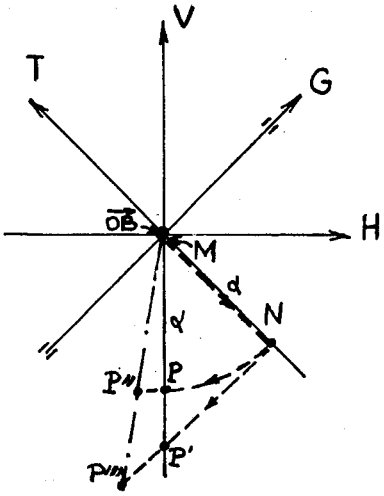
FIG. 5 schematically shows the displacements of the axes of sight and of range in a front plane perpendicular to the axis OB represented in FIG. 4.

The correction for aim is obtained by shifting the line of observation for the angle of aim corresponding to the distance of the target. In fact, the angle of aim read on the firing table is given when the axis of rotation of the turret is in the vertical plane passing through the direction of the target. The apparatus according to the invention permits shifting the line of observation for an angle equal at the aim in the vertical plane passing through the direction of the target, the position of the line of observation after correction being designated L. FIG. 4 shows that the shift angle $\alpha$ of the line of observation can be made by shifting the line of observation for the angle of aim in the plane passing through the axis of rotation T of the turret and them making the line of observation rotate around the direction B of the target. The shift of the line of observation on the trigonometric sphere is designated MP, this shifting being decomposed in MN and NP. The corrections are also represented in FIG. 5 in the front plane perpendicular to direction B.

Figure 6:
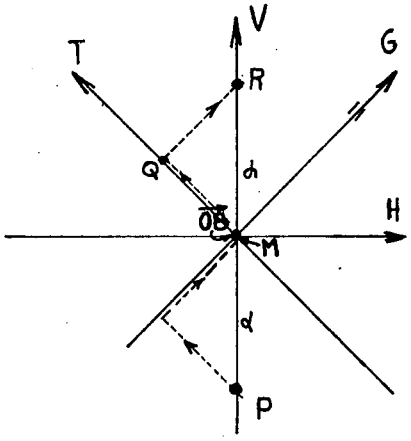
FIG. 6 schematically shows in the same front plane, the displacements of the cannon.

After determination of the corrections, the line of sight is reset on the target and the axis of the cannon is displaced for the angle of aim $\alpha$ with respect to the direction of the target to take the direction C, in the vertical plane passing through the direction B. This offset of the cannon is decomposed into a displacement around its turning axis G designated MQ and in a rotation of the turret designated GR (FIGS. 4 through 6).

Figure 7:
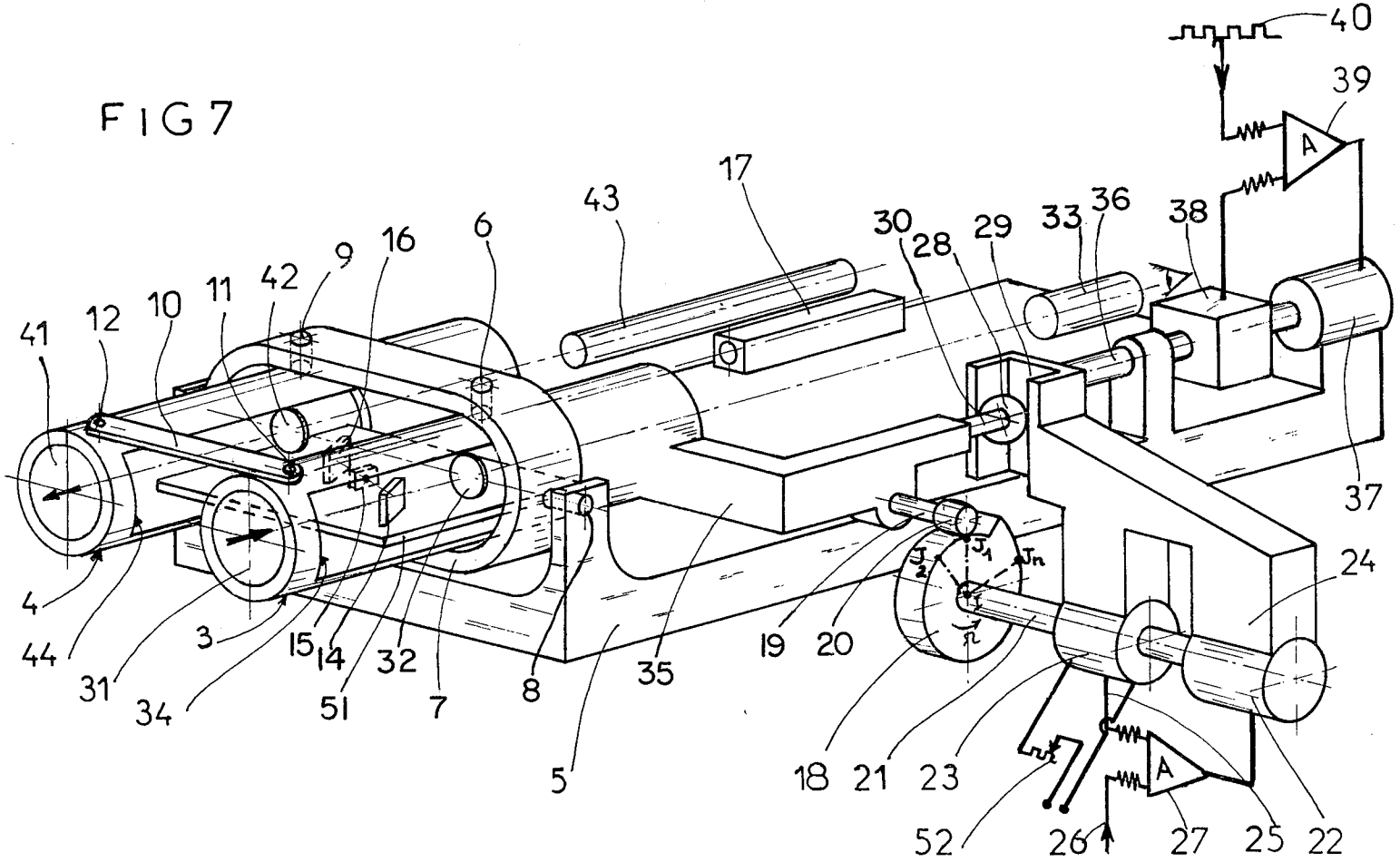
FIG. 7 shows a first embodiment of the apparatus according to the invention.
Figure 8:
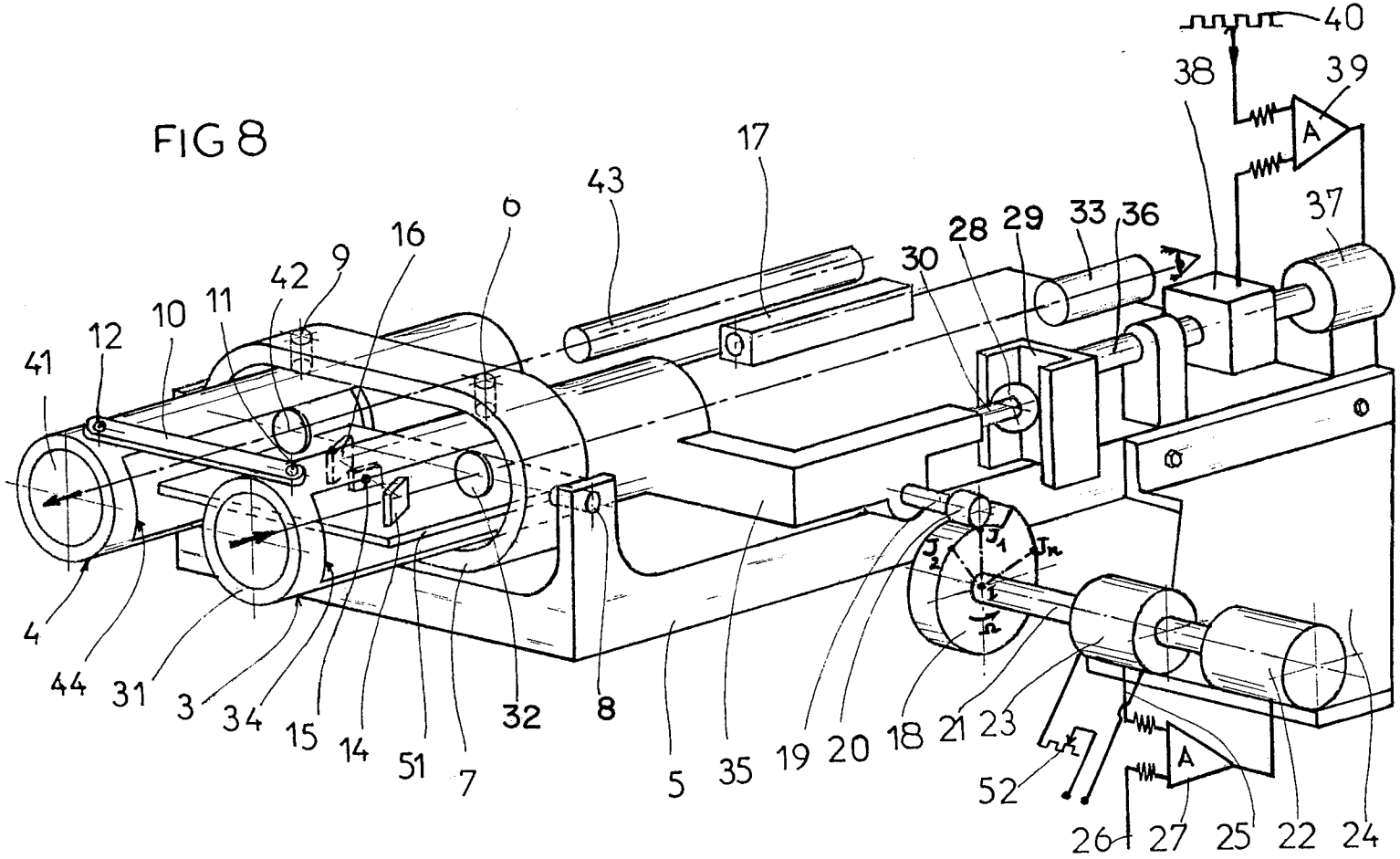
FIG. 8 shows a variation of the embodiment represented in FIG. 7.

The apparatus represented in FIGS. 7 and 8 comprises an observation scope 3 and a scope 4 for the laser rangefinder. The assembly is mounted on a support 5 connected in elevation and bearing to the cannon, this support being advantageously constituted by the member known as the shield.

The observation scope 3 and the scope 4 are each mounted through the intermediary of a spherical joint of the cardan type on the support. The articulation with the cardan joint of the scope 3 comprises pivots 6 which are mounted in a sleeve 7 surrounding the scope, this sleeve being articulated on the support through the intermediary of pivots 8. The axes of the pivots 8 and 6 are perpendicular to one another, the axis of pivots 8 being parallel or not to the turning axis of the cannon. The articulation with the cardan joint of the scope 4 is composed of pivots 9 which are parallel to the axis 6 and are mounted in the sleeve 7 articulated around pivots 8. The scopes 3 and 4 are connected to one another by a connecting rod 10 which is articulated to the scope 3 by an articulation 11 parallel to axes 6 and 9 and on the scope 4 by an articulation 12 parallel to the axes 6 and 9. The articulations 11, 12, 6 and 9 occupy the apexes of a parallelogram. In this manner the scopes 3 and 4 oscillate simultaneously around axes 6 and 9, the optical axes remaining parallel.

The observation scope comprises an objective 31, crosshairs 32 and an ocular sighting apparatus 33 which is represented in a simplified manner in the drawing. The scope 4 comprises an objective 41 and a divergent lens 42. The laser beam is transmitted by a laser emitter 43 situated in back of the divergent lens 42. In return, the laser beam passes through the objective 31, serving as the ocular observation element, is reflected on a dichroic plate 14, passes through a field diaphragm 15, is reflected on a dichroic plate 16, and is finally received by the receiver 17.

The cross-hairs 32, the divergent lens for transmission 42, the diachroic plates 14 and 16 and the field diaphragm 15 are fixed to the support 5 through the intermediary of a support 51. This support 51 passes through openings 34 and 44 which are provided respectively in the scopes 3 and 4 while permitting the oscillation of these scopes. The laser emitter 43 and the laser receiver 17 are also fixed to the support 5. This mounting assures good thermal stability and gives to the system fixed optical properties. The focal plane of the objective 31 passes through the center of articulation of the scope 3, which avoids defocalization due to the fact that the reception system 14,15,16,17 remains immobile. Similarly, the focal plane of the objective 41 passes through the center of articulation the scope 4.

The apparatus comprises a cam 18 serving to orient the scopes 3 and 4 around their spherical articulation through the intermediary of an arm 35, a shaft 19 secured to the arm, and a roller 20 riding on the profile of the cam. The support of the roller 20 on the cam 18 is obtained by the weight of the scopes but can be reinforced by the action of a spring. The cam is secured with a drive shaft 21 coupled to a motor 22 and guided in rotation in a support 24. The position of the motor is marked by a coder 23. The signals furnished by the coder 23 and by the laser receiver 17 are transmitted, respectively by a conductor 25 and by a conductor 26, to an adder 27 which controls the motor 22 serving to drive the cam. The cam can oscillate in the direction of rotation$\Omega$ in the proportion to the increase of the distance signal of the laser rangefinder, the successive radii $IJ_1$, $IJ_2$. . . $IJ_n$ then increasing. Each radius corresponds to the distance measured by the laser rangefinder and the length of this radius is proportional to the aim value corresponding to this distance.

As has already been explained, the line of sight is displaced in a vertical plane passing through the direction of the target. One of the scopes is secured to a slide 28 through the intermediary of a shaft 30. This slide slides on a rectilinear guide member 29. This guide member, constituted for example by a groove, is mounted on a shaft 36 which is guided in a bearing carried by the support 5. The shaft 36 is coupled to a motor 37, and to a detector of the vertical 38, serving for control of the motor. The connection between the slide 28 and the groove 29 must permit the relative orientation of the groove 29 and the scope. The shape of the slide 29 can be spherical. Preferably, the shaft 36 is parallel to the axis of the cannon and to the axes of the scopes which are parallel to the axis of the cannon before the determination of the corrections. Whatever the orientation of the support, the groove 29 will be oriented in a vertical plane by the motor 37. Since there is practically no lateral displacement of the groove with respect to the support 5 and with respect to the axis of the cannon, that is to say with respect to the direction B of the target, the displacement of the observation line is properly effected in the vertical plane passing through the direction of the target, that is to say the length of the arc MS designated in FIG. 4.

In the embodiment of FIG. 7, the support 24 of the cam is coupled to the motor 37 for vertical control. The axis of rotation 21 of the cam is placed horizontally during the phase of determination of errors, the radius of the cam is selected by the motor 22 being placed vertically. The inclination of the lines of sight of the scopes is therefore exactly equal to the angle of aim designated $\alpha$ in FIG. 4.

In the embodiment of FIG. 8, the support 24 of the cam is secured to the support 5 and therefore remains immobile when the groove 29 orients itself in the vertical plane passing through the direction of the target. If the axis 21 is parallel to the turning axis of the cannon and if the groove 29 is in a plane passing through the axis of rotation of the turret, the rotation of the cam 18 under the action of the rangefinder shifts the sight line by the value of the aim in the plane passing through the axis of the turret. This shift is designated MN in FIGS. 4 and 6. If the groove 29 is reset in the vertical plane the roller 20 slides on the cam 18 along a distance substantially perpendicular to the preceding shift and which is designated NP' in FIG. 5. The shift of the line of sight in the vertical plane is not exactly equal to the aim value, the error being designated PP' in FIG. 5. This error remains despite being negligible (several tens of thousandths).

The secondary corrections can be obtained by acting solely on the existing controls.

In order to taken into account the initial speed and the ballistic coefficient it is necessary to make a correction in elevation which is substantially proportional to the actual distance, the coefficient of proportionality being in the neightborhood of 1. This correction is obtained by multiplying the signal coming from a coder of the control of aim by a co-efficient of proportionality. One solution consists of using a linear potentiometer as a control coder 23 and varying the voltage at the terminals of this potentiometer, for example by means of a rheostat 52.

The parameters of lateral wind forces and of lateral shift of the ammunition require corrections in bearing substantially proportional to the angle of aim. These corrections can be introduced by adding a constant voltage, judiciously chosen, to the signal of the vertical detector. A potentiometer 40 can be used whose signal is introduced into the adder 39 controlling the motor 37 and receiving the signal from the vertical detector 38. This additional signal inclines the guide member 29 with respect to the vertical and deviates the line of observation in bearing following the trajectories PP" or P'P'" designated in FIG. 5. This change necessitates either a change in the cam or a "heart" cam one lobe of which is reserved for one ammunition, one lobe for another. For all the other parameters and adjustments, the charge in ammunition only acts on the potentiometers and the resistances. An electric permutator can be used.

The operation of the embodiments in FIGS. 7 and 8 will now be explained.

In initial position, the guide member is in a plane passing through the axis of the turret. The scopes and the cannon are pointed towards the objective. The distance is measured. The guide member turns according to the inclination of the turret and the sight cam 18 takes the position corresponding to the distance measured by the rangefinder. The observation scope is then re-centered on the objective.

Figure 9:
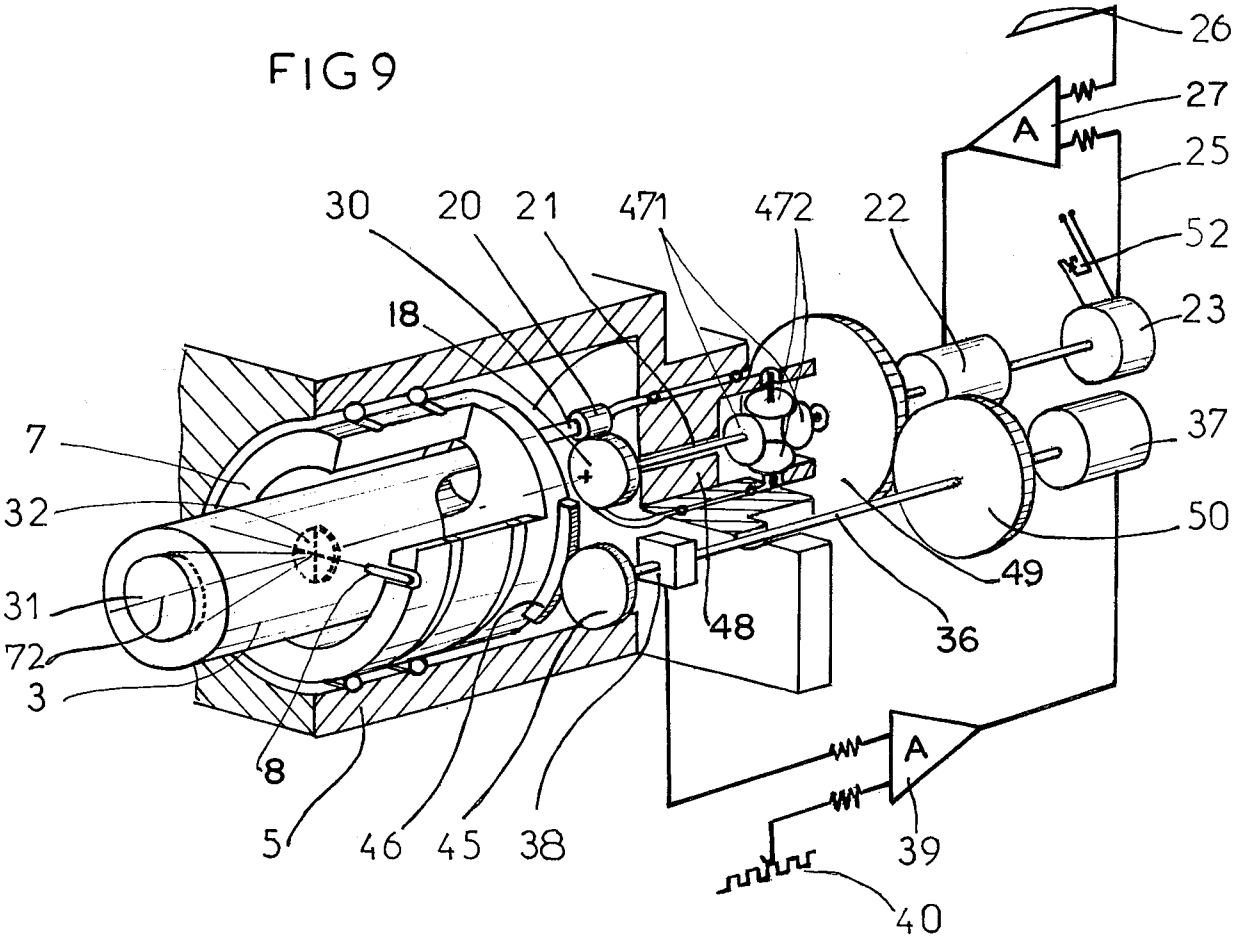
FIG. 9 shows a second embodiment of the apparatus according to the invention.

FIG. 9 represents another embodiment of the apparatus according to the invention. The spherical articulation of the scope 3 on the support 5 connected to the cannon comprises a sleeve 7 surrounding the scope. This sleeve is guided in rotation around its axis 72 by balls. The scope is mounted on the sleeve through the intermediary of pivots 8 whose common axis is perpendicular and coincident with the axis of rotation of said sleeve. The sleeve 7 is coupled to a shaft 36 through the intermediary of a pinion 45 and a toothed sector 46. This shaft is coupled to a detector of the vertical 38 and to a motor 37 controlled by this detector.

The control of the sight of the scope 3 is effected by a cam 18 on which the scope is supported through the intermediary of an arm 30 provided with a roller 20 which rides on the cam. This cam is mounted on a shaft 21 which is driven in rotation by a motor 22 coupled to a coder 23 marking the position of the axis of the motor. The motor is controlled by an adder 27 receiving the signal of the controlling coder and the signal of the laser rangefinder which is not shown, this rangefinder being integrated in the observation scope. The motor 22 drives the cam 18 through the intermediary of a differential comprising, on the one hand, coaxial pinions 471 coupled, one to the cam, the other to the motor, and on the other hand, planetary pinions meshing with the preceding ones. These planetary pinions 472 are guided in a support 48 capable of pivoting around shaft 21 through the intermediary of a pinion 49 meshing with a pinion 50 secured to the shaft 36 of the control for verticality. This differential system is constructed in order that a rotation of the scope 3 introduces an equal rotation in the same direction of sight cam 18, this rotation combining with the rotation due to the motor 22.

The operation of this embodiment is the following. In initial position, the axis 8 is parallel to the turning axis of the cannon. The scope is pointed at the target by displacement of the cannon and of the turret. The distance is measured by the laser rangefinder. The shaft 7 pivots under the action of the motor 37 in a manner such that the pivots 8 must be horizontal. This rotation doesn't displace the roller 20 with respect to the cam 18 due to the differential system. The sight cam 18 gives the desired offset to the scope as a function of the indication from the laser rangefinder.

The controlling coder 23 is a linear potentiometer and a rheostat 52 permits varying the voltage at the terminals of the potentiometer. A corection in site to take into account the initial speed and the ballistic coefficient can be introduced by varying the voltage to the terminals of the potentiometer 52. A potentiometer 40 furnishes a signal to the adder 39 controlling the motor 37 and receiving the signal from the detector of the vertical 38. The addition of a constant voltage to the signal of the detector of the vertical thus permits making corrections in bearing to take into account the parameters of lateral wind forces and of lateral shift of the ammunition.

Figure 10:
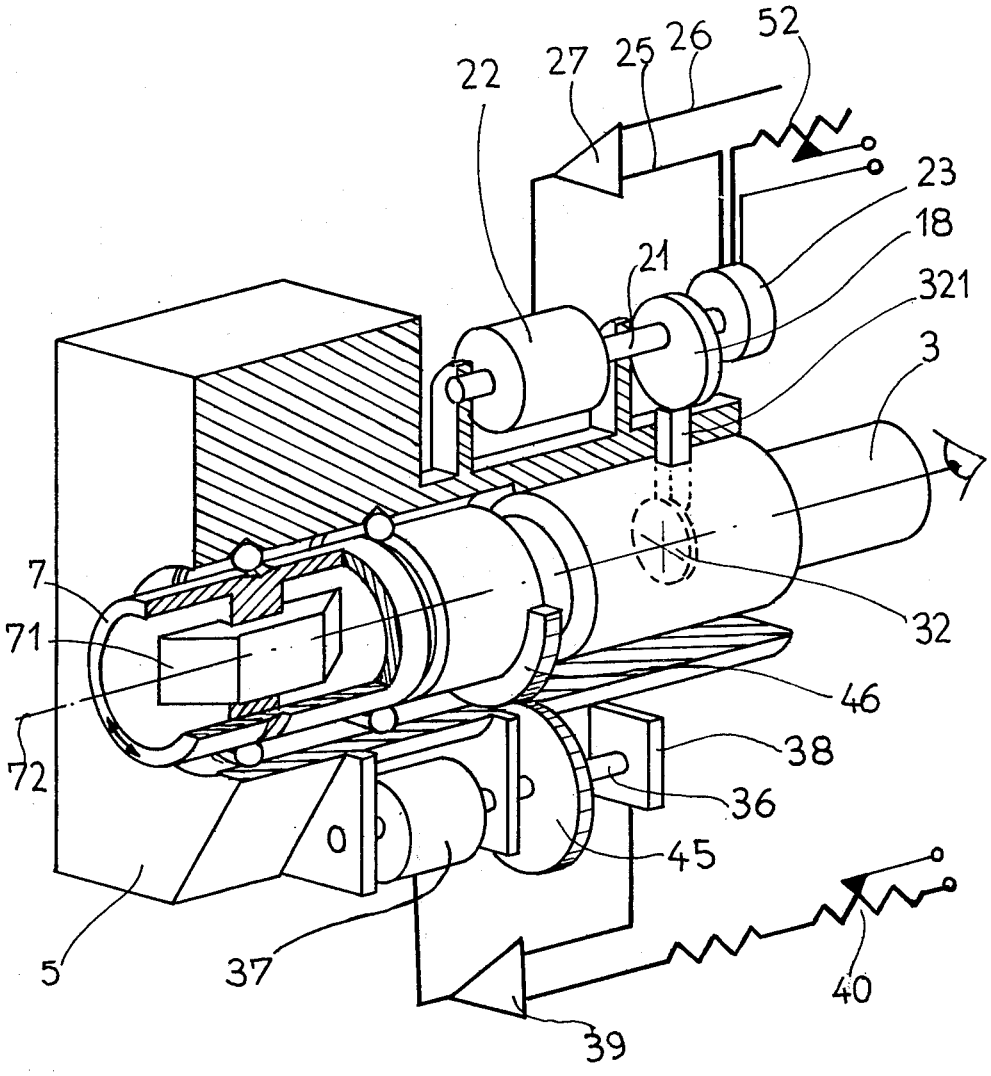
FIG. 10 shows another embodiment of the apparatus according to the invention.

The apparatus represented in FIG. 10 comprises a scope 3 mounted in a support 5 connected in bearing and in elevation to the cannon and which can be the shield. The scope comprises a movable optical element serving to deviate the line of observation of the scope in a plane perpendicular to the axis of the pivots of the cannon. This deviator is constituted by a movable cross-hair, guided perpendicularly to the axis of the pivots by a guide rod 321 sliding in the support. The optical deviator element is fastened to a cam 18 which turns around a shaft 21. The profile of the cam is determined by the relation of the aim as a function of the distance from the table of firing for the nominal values of the parameters. The deviator member could be constituted instead of the cross-hairs by a mirror.

The cam 18 is driven by a motor 22 whose position is marked by a coder 23. The signals furnished by the coder and by the laser receiver, which is not shown, are transmitted respectively in 25 and in 26 to an adder 27 which controls the motor 22 serving to drive the cam.

In front of the scope, that is to say, at the side of the target, is disposed a prism 71 turning around an axis 72 which corresponds to the observation line for a zero aim value. This prism is mounted in a sleeve 7 guided around the axis 72, in the support 5, by roller members. The prism 71 is constituted by prism having an odd number of reflections, for example a Wollaston prism. It is known that if such a prism can turn around an axis parallel to its base and that an observer looks through it at an object, for example, at a landscape, turning around the same axis, it is possible to maintain the image of this object immobile for the observer. For this, the prism must be driven at a speed in the same direction as the speed of the object but equal to one-half. The sleeve is driven in rotation by a toothed sector 46 and by a gearing 45 secured to a shaft 36 driven in rotation by a motor 37. The shaft 36 is coupled to a vertical detector 38 by a feedback loop. The mechanical transmission 45–46 is such that when an inclination is marked by the vertical detector, a rotation equal to the portion of the angle of the inclination is applied to the prism 71 around the shaft 72.

The operation of this embodiment is explained hereafter.

In initial position, the aim angle is zero and the line of observation is the axis 72. As a function of the distance of the target, the cam 18 causes deviation of the line of observation by displacing the optical deviator element 32. If the inclination is zero this line of observation is displaced in a vertical plane passing through the direction of the target and no correction due to the inclination is necessary. If an inclination exists, this introduces an error in bearing which is proportional to the aim angle. The influence of the inclination is cancelled by causing the prism 71 to turn around the optical axis 72 which is coincident with the observation at zero aim. The rotation of the prism is controlled by the vertical detector 38. The image seen in the field of the glass undergoes, with respect to the landscape, a rotation equal to the inclination. In the field of the scope, a horizontal of the landscape appears parallel to the horizontal line of the cross-hairs which is itself parallel to the pivot axis of the cannon, it being understood that the image of the horizontal of the outside landscape and the horizontal line of the cross-hairs are therefore inclined with respect to the horizontal. Similarly, a vertical line of the landscape appears parallel to the vertical line of the cross-hairs, that is to say parallel to the axis of rotation of the turret. With reference to FIG. 5, the direction of the image of the vertical in the field of the scope is coincident with the axis T of rotation of the turret, whereas the direction of the image of the horizontal H is coincident with the turning axis G. The aim is designated by MN if the field image is considered. The aim can be usefully determined by a displacement of the line of observation in the plane perpendicular to the turning axis, particularly by displacement of the cross-hairs 32. The observation axis remains in the image of the vertical plane of the image passing through the direction of the target.

It is understood that in the embodiments of FIGS. 7, 8, 9, the image of the landscape doesn't move in the field of the scope, which necessitates, in order that the inclination isn't a factor, the maintenance of the line of observation in a vertical plane passing through the direction of the target. In the embodiment of FIG. 10, the rotation of the image of the landscape avoids the error due to the inclination.

The secondary corrections are effected in the embodiment of FIG. 10 in the same fashion as in the embodiments of FIGS. 7, 8, 9, that is to say in acting on the control members.

To take into account the initial speed and the ballistic coefficient, a correction in aim is effected, this correction being substantially proportional to the actual distance. The coder 23 is a potentiometer and a variation of the feed voltage of the potentiometer by means of a rheostat 52 permits making the scale of distances proportional thereto.

The corrections in bearing of lateral shift and of lateral wind force which are proportional to the angle of aim and are introduced by adding a constant voltage to the signal of the vertical detector. A potentiometer 40 is used, whose signal is fed to the adder 39 which receives the signal of the vertical detector to control the motor 37.

What is claimed is:

1. In an apparatus for conducting firing adapted to the aiming of a cannon movable in bearing and in elevation around a turning axis as a function of the aim values given from a table of firing corresponding to the cannon and of other parameters of firing and comprising an observation scope with an optical deflector element serving for the displacement of the line of sight, support means mounting said optical deflector and connected in bearing and in elevation with the cannon, cam means for moving said support means including a movable cam having a profile determined by the aim values from the table of firing, motor means for driving the cam, rangefinder means operatingly coupled to the motor means, said rangefinder means having transmission and receiving beams connected in bearing and in elevation to the axis of the observation scope, the improvement wherein said support means comprises a spherical articulation assembly pivotably supporting said optical deflection element for spherical movement and vertical detector means coupled to said optical deflector element for maintaining the axis of sight in a substantially vertical plane passing through the direction of the target.

2. Apparatus as claimed in claim 1, wherein said scope has an objective constituted by said optical deflector element and fixed cross-hairs in said objective.

3. Apparatus as claimed in claim 1, wherein said spherical articulation assembly comprises a cardan joint, a rectilinear guide member, a rotatable shaft securely mounting said guide member and coupled to the vertical detector means, a motor controlled by said vertical detector means and drivingly coupled to said shaft, and a slide secured to the optical deflector element and guided in said rectilinear guide member.

4. Apparatus as claimed in claim 3 comprising a shaft coupled to said cam to drive the same in rotation, and guide means secured to the rectilinear guide member and guidably supporting said shaft along an axis perpendicular to the direction of the rectilinear guide member.

5. The apparatus as claimed in claim 3 comprising a shaft coupled to said cam to drive the same in rotation, said shaft being guided in rotation by said support means.

6. Apparatus as claimed in claim 1 comprising means for producing a laser transmission beam including a scope, a cardan joint connecting said laser scope and said observation scope to the support means for respective pivotal movement about mutually perpendicular axes, one of the axes of the cardan joint for the laser scope being said cardan joint coaxial with one of the axes of the cardan joint of the observation scope, the other axis of the cardan joint of the laser scope being parallel to the other axis of the cardan joint of the observation scope, and means pivotably coupling the laser scope and the observation scope.

7. Apparatus as claimed in claim 1 comprising at least one support fixed directly on said support means and carrying cross-hairs and the telemeter means.

8. Apparatus as claimed in claim 3 wherein said rangefinder means comprises a rangefinder scope, said spherical articulation assembly comprising a sleeve surrounding the rangefinder scope and supported for rotation around an axis on said support means, said sleeve being coupled to and driven in rotation by said motor controlled by the vertical detector means.

9. Apparatus as claimed in claim 8, comprising a motor for driving said cam, a differential between said cam and said motor, and means coupling said differential to the motor for drive of the sleeve around its axis.

10. Apparatus as claimed in claim 1 comprising a feedback loop receiving signals from said rangefinder means, and a coder in said feedback loop, said movable cam being operatively coupled to said coder.

11. Apparatus as claimed in claim 10 comprising means for multiplying the signal from the coder for the control of observation and means for adding a signal to the signal from the vertical detector means.

12. In an apparatus for conducting firing adapted to the aiming of a cannon movable in bearing and in elevation around a turning axis as a function of the aim values given from a table of firing corresponding to the cannon and of other parameters of firing and comprising an observation scope with an optical deflector element serving for the displacement of the line of sight, support means mounting said optical deflector element and connected in bearing and in elevation with the cannon, cam means for moving said support means including a movable cam having a profile determined by the aim values from the table of firing, motor means for driving the cam, rangefinder means operatively coupled to the motor means, said rangefinder means having transmission and receiving beams connected in bearing and in elevation to the axis of the observation scope, the improvement comprising means for guiding said optical deflector element to displace the line of sight in a plane perpendicular to the turning axis, vertical detector means, motor means driven by said vertical detector means and a second optical deflector element movable under the action of said motor means to cause the image of the landscape to turn such that a vertical line through the landscape is substantially perpendicular to the turning axis.

13. Apparatus as claimed in claim 12 comprising an optical element in said scope constituted by a prism having an odd number of reflection faces turnable around an axis under the drive of said motor means as controlled by the vertical detector means.

14. Apparatus as claimed in claim 13 comprising a second movable optical element in said scope controlled by said cam and including cross-hairs.

15. Apparatus as claimed in claim 12 comprising a feedback loop receiving signals from said rangefinder means, and a coder in said feedback loop, said movable cam being operatively coupled to said coder.

16. Apparatus as claimed in claim 15 comprising means for multiplying the signal from the coder for the control of observation and means for adding a signal to the signal from the vertical detector means.

* * * * *